United States Patent [19]

Houston

[11] Patent Number: 4,964,529

[45] Date of Patent: Oct. 23, 1990

[54] GAS TANK CONTAINER

[76] Inventor: Robert S. Houston, 2390 Bowker Avenue, Victoria, Canada, V8R 2E6

[21] Appl. No.: 373,750

[22] Filed: Jun. 30, 1989

[51] Int. Cl.[5] ..... B65D 25/18

[52] U.S. Cl. ..... 220/402; 220/3; 220/375; 220/444; 220/445; 206/523

[58] Field of Search ..... 220/413, 411, 402, 444, 220/445, 3, 375, 18; 206/523, 521

[56] References Cited

U.S. PATENT DOCUMENTS

| | | | |
|---|---|---|---|
| 1,806,560 | 5/1931 | McKinley . | |
| 2,465,095 | 12/1944 | Harvey | 220/46 |
| 2,979,246 | 4/1961 | Liebeskind | 206/523 |
| 2,996,213 | 8/1961 | Mitchell et al. | 220/9 |
| 3,120,319 | 2/1964 | Buddrus | 206/523 |
| 3,212,660 | 10/1965 | Adell | 220/18 |
| 3,345,245 | 10/1967 | Hanusa | 220/444 |
| 3,635,380 | 1/1972 | Fitzgerald | 220/367 |
| 3,669,299 | 6/1972 | Jones et al. | 220/445 |
| 3,730,374 | 5/1973 | Picciano et al. | 220/445 |
| 3,788,511 | 1/1974 | Marsh | 220/455 |
| 3,982,029 | 9/1976 | Rausing | 220/402 |
| 3,997,072 | 12/1976 | Guth | 220/402 |
| 4,217,011 | 8/1980 | Davis | 220/411 |
| 4,496,073 | 1/1985 | Silver et al. | 220/445 |
| 4,560,069 | 12/1985 | Simon | 220/444 |
| 4,578,137 | 3/1986 | Kring | 220/445 |
| 4,619,374 | 10/1986 | Yavorsky | 220/3 |
| 4,643,825 | 2/1987 | Weslowski | 220/375 |
| 4,690,299 | 9/1987 | Cannon | 220/402 |
| 4,793,491 | 12/1988 | Wolf et al. | 220/414 |
| 4,802,515 | 2/1987 | Pytryga et al. | 220/411 |

FOREIGN PATENT DOCUMENTS

| | | | |
|---|---|---|---|
| 2018974 | 3/1979 | United Kingdom | 220/411 |

OTHER PUBLICATIONS

Watertight, Vented Propane Gas Lockers—Marine Energy Systems Inc. Cruising World, p. 248—Oct. 87.

*Primary Examiner*—Stephen Marcus
*Assistant Examiner*—S. Castellano
*Attorney, Agent, or Firm*—Townsend and Townsend

[57] ABSTRACT

A container for enclosing a liquified gas tank protects the tank from rough handling and prevents the corrosion from exposure to the atmosphere. The container comprises a vertical cylindrical shell with bottom cap attached thereto, formed of resilient plastic non-combustible material, the inside diameter of the shell being greater than the outside diameter of the gas tank; removable friction fit lid fitted to the top of the shell, adapted to lift off under internal pressure in the shell, impact absorbing bottom pad on the inside of the bottom cap to support the gas tank; at least one impact absorbing side pad between the shell and the gas tank to support the tank within the shell, with passage for gas to vent down from the top of the gas tank to the bottom cap of the shell, and gas vent in the bottom cap of the shell to vent gas out of the shell.

9 Claims, 1 Drawing Sheet

GAS TANK CONTAINER

BACKGROUND OF THE INVENTION

The present invention relates to a container for enclosing a liquified gas tank and more specifically to a container that protects a gas tank from handling and reasonable knocks. It also protects a gas tank from corrosive effects of exposure to air, salt water and the like.

Liquified gas tanks, such as propane tanks, are used in pleasure boats, both sail and power boats, for cooking, heating, refrigerators and the like. There is a requirement to mount a gas tank outboard because such tanks have propane gas which is heavier than air, and if the tank is inside the boat then a gas leak from the tank flows downwards and fills the bilges and the hull of the boat. This becomes very dangerous as liquid propane gas and other combustible gases can ignite and many accidents have occurred for just this reason.

AIMS OF THE INVENTION

By mounting the gas tank outboard, and gas leak vents downwards outside the boat. One problem, however, that exists with mounting a gas tank outboard is that it is now exposed to sea water and weather conditions which may corrode the tank. And because it is outboard, the tank may be subject to rough handling or knocks and the like particularly when berthing the boat. Thus there is a need for a container to hold a liquified gas tank that protects the tank from the corrosive effects of exposure, is safe in that if a buildup of pressure occurs within the container it can vent downwards or alternatively the lid is blown off, and also protects a gas tank from reasonable knocks.

Not only is such a container suitable for boats but also may be provided in other fields where liquified gas is used. For instance recreational vehicles and at-home barbecues both use propane tanks. Furthermore, the container may be used with other types of gas, such as liquid alcohol bottles, divers oxygen tanks, medical gases and carbon dioxide tanks used in restaurants for carbonated beverages.

SUMMARY OF THE INVENTION

The present invention provides a container that holds a high pressure gas tank. The container is made of material that has a high resistance to the corrosive effects of exposure to most chemicals and salt water. It does not support its own combustion and has a high impact resistance, which in most cases after only a moderate impact returns to its original shape. In addition the tank has built in impact absorbing pads and retaining pads to absorb moderate shocks on the container and thus protects the tank itself. The container has a gravity vent that permits gases that could collect within the container to vent downwards, and in the case of the container being mounted outboard of a boat, then a hose can extend below the container from a bottom vent to ensure that gases vent close to the water line well outside the boat and are not blown back into the boat by wind or the like.

The present invention provides a container for a high pressure gas tank, comprising a vertical cylindrical shell with bottom cap attached thereto, formed of resilient plastic non-combustible material, the inside diameter of the shell being greater than the outside diameter of the gas tank; removable friction fit lid fitted to the top of the shell, adapted to lift off under internal pressure in the shell; impact absorbing bottom pad on the inside of the bottom cap to support the gas tank; at least one impact absorbing side pad between the shell and the gas tank to support the tank within the shell, with passage for gas to vent down from the top of the gas tank to the bottom cap of the shell, and gas vent in the bottom cap of the shell to vent gas out of the shell.

BRIEF DESCRIPTION OF THE DRAWINGS

In drawings which illustrate embodiments of the invention:

FIG. 1 is an isometric side view showing one embodiment of a container according to the present invention mounted outboard of a boat or the like.

DESCRIPTION OF A PREFERRED EMBODIMENT

Figure 1:
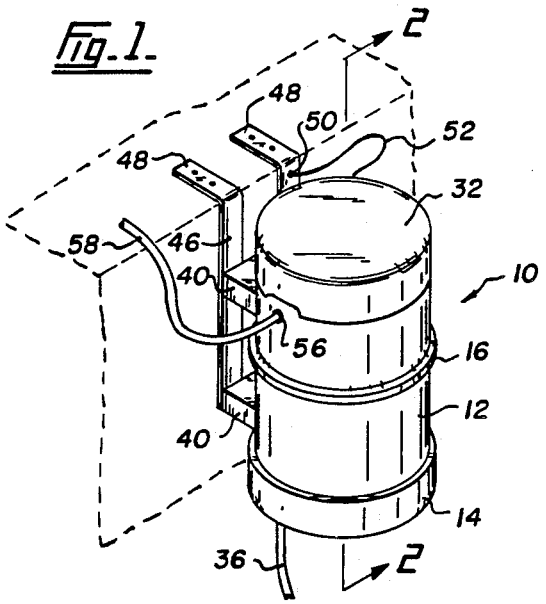

Referring now to the drawings, it is know that most liquified gas tanks such as propane tanks are generally cylindrical often with spherical or curved ends for maximum strength to contend with gas pressures within the tank. The container 10 has a generally cylindrical shell 12 with an inside diameter considerably greater than the diameter of the gas tank, and a bottom cap 14 attached to the bottom of the shell 12 with strong plastic adhesive, plastic welding or other suitable permanent attachment. The shell 12 is formed of resilient plastic non-combustible material, preferably a polyvinyl chloride high impact pipe. A circular rib 16 is provided in the centre of the shell 12 to improve strength. The shell 12 itself has high impact resistance, and in most cases after moderate impact returns to its original shape, furthermore PVC is easy to clean, does not corrode and is resistant to the effects of most solvents and chemicals. PVC is also resistant to discoloration from sunlight and does not conduct electricity. This material is ideal for the application in that the container can be made substantially waterproof thus protecting the contents.

Figure 2:
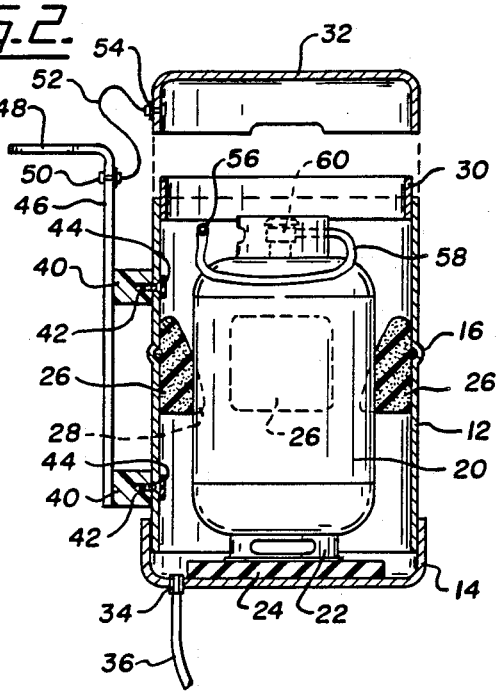
FIG. 2 is a side sectional view through the container of FIG. 1.

As shown in FIG. 2 a liquified gas tank 20 such as a propane tank fits within the shell 12 with the diameter of the tank 20 being considerably less than the inside diameter of the shell 12. At the bottom of the gas tank 20 is a stand 22 which is common to most of the regular propane tanks available today, this stand has a rolled edge and an impact absorbing bottom pad 24 is positioned on the inside of the bottom cap 14, being held there either by a suitable adhesive or screw attachment. This impact absorbing bottom pad 24 is preferably formed from a flexible foam material, such as a hard foam rubber, to absorb shocks from the up and down movement of the tank 20 within the container 10. Four impact absorbing side pads 26 are positioned approximately in the centre of the inside of the shell 12. The pads 26 as can be seen are tapered being thinner at the top and wider at the bottom and therefore act to wedge a gas tank 20 in the container 10 and also grip the tank 20 so that it cannot easily move within the container 10. The impact absorbing side pads 26 are also preferably made from a hard foam rubber similar to the impact absorbing pad 24. If a knock or impact occurs on the outside shell 12, then the resilient material of the shell and the pads 26 absorbs a fair amount of shock thus cushioning the tank 20. Spaces 28 or gaps are provided between the pads 26 to ensure that there is a gravity vent from the top of the tank 10 downwards inside the container 10.

At the top of the shell 12 is a plastic ring 30 inserted within the outer shell 12 and firmly attached thereto either by a suitable adhesive, welding or attachment screws, to provide a lip over which a removable friction fit lid 32 is placed. The lid 32 and the top ring 30 are made from resilient plastic material, preferably the same as the shell 12 and because the lid has a removable friction fit, a buildup of pressure within the container 10 forces the lid 32 to blow off the container. The friction fit lid 32 generally makes the container waterproof so that if the container was mounted outboard of a boat, and a wave passed over the container, then little or no water would enter the interior.

A gravity vent 34 is provided in the bottom cap 14 attached to a short vent hose 36. The vent 34 allows any gases heavier than air that are contained within the container 12 to vent downwards through the vent hose 36. The hose 36 is flexible and generally extends down to approximately the surface of the water well outside a boat so that any gas that should vent is released down at the water level, well below the deck of a boat, and therefore cannot enter the boat. This provides safety in the case of a gas leak. Furthermore, the hose 36 prevents sea water from splashing up through the vent and entering the interior of the container 10.

Attached to the exterior of the shell are two saddles 40 positioned one above the other. The saddles 40 are held to the shell 12 by means of set screws 42 having plastic covers 44 so that the metal is not exposed within the container 10. In the embodiments shown, the saddles 40 extend for approximately one third the way around the circumference of the shell 12, and are attached to two vertical support brackets 46 by screws or other suitable attachments. The brackets are preferably formed from stainless steel and are therefore noncorrosive. The brackets are L-shaped having top flanges 48 which permit mounting outboard from a deck or side of a vessel as illustrated in FIG. 1. An attachment ring 50 on the top bracket 46 is connected to a thin stainless steel cable 52, referred to as an aircraft cable, which in turn is joined to another attachment 54 on the removable friction fit lid 32. This cable 52 holds the lid 32 should it come off or be blown off the container 10, and prevents it falling over board in the case of use of a boat.

A bulk-head fitting 56 is provided for a gas line 58 from the valve 60 on the top of the gas tank 20. The gas line 58 loops around the tank 50 and has sufficient length so that the tank may be removed from the container 10 before being disconnected at the valve 60. Thus if a container 10 is mounted out board on a boat, the tank 20 may be lifted in board and the connection for the gas line 58 removed while the tank is in board.

Whereas the bracket arrangement illustrated in the drawings is suitable for a boat. Modifications may be made to the bracket so that it can be mounted on a recreational vehicle, used outside a house or cabin. Furthermore the container may be provided for household barbecues to avoid the propane tanks becoming rusty which unfortunately is common. The container provides complete weather proof protection for the propane tank. It is important that a vent at the bottom of the container is provided even though the vent hose 36 is not essential when not used in a boat. However, if attached to a recreational vehicle or the like it is always preferable to vent the gas well below the vehicle at ground level particularly with heavier gases so they are not blown up into a vehicle.

Whereas a propane tank or liquified gas tank has been described herein. The container may also be used for other types of tanks, compressed air tanks, carbon dioxide tanks and the like that have to be stored outside, or are exposed to corrosive or other conditions.

Various changes may be made to the embodiments shown herein without departing from the scope of the present invention which is limited only by the following claims.

The embodiments of the present invention in which an exclusive property or privilege is claimed are defined as follows:

1. Container to provide impact and corrosion protection for a high pressure gas tank, comprising a vertical cylindrical shell with bottom cap attached thereto, formed of resilient plastic non-combustible, corrosion resistent material, the inside diameter of the shell being considerably greater than the outside diameter of the gas tank;

removable lid frictionally fitted to the top of the shell, adapted to lift off under internal pressure in the shell;

impact absorbing bottom pad on the inside of the bottom cap to support the gas tank;

at least one impact absorbing side pad of a thickness sufficient to extend between the shell and the gas tank to support the tank within the shell, with passage for gas to vent down from the top of the gas tank to the bottom cap of the shell, side brackets attached to said shell for vertical support of the container; and gas vent in the bottom cap of the shell with flexible hose attached thereto, to vent gas out of the shell.

2. The container according to claim 1 including a bulk-head fitting in the shell for a gas line from the gas tank.

3. The container according to claim 2 wherein the bulk-head fitting is located in the shell above the impact absorbing side pad.

4. The container according to claim 1 wherein four separate impact absorbing side pads are generally equally spaced around the interior surface of the cylindrical shell.

5. The container according to claim 4 wherein the impact absorbing side pads are formed of foam plastic.

6. The container according to claim 4 wherein the impact absorbing side pads are tapered being thinner at the top and wider at the bottom to wedge the gas tank in the container.

7. The container according to claim 1 wherein the cylindrical shell, bottom cap and lid are all formed of polyvinyl chloride.

8. The container according to claim 1 including a safety cable from one of the side brackets attached to the lid.

9. The container according to claim 1 wherein the high pressure gas tank is a propane tank.

* * * * *